US009203174B1

(12) United States Patent
O'Neill et al.

(10) Patent No.: US 9,203,174 B1
(45) Date of Patent: Dec. 1, 2015

(54) VEHICLE POWER CONNECTOR

(71) Applicant: O'Neill Components LLC, Eatonville, WA (US)

(72) Inventors: Darren O'Neill, Eatonville, WA (US); Steve O'Neill, Eatonville, WA (US)

(73) Assignee: O'Neill Components LLC, Eatonville, WA (US)

( * ) Notice: Subject to any disclaimer, the term of this patent is extended or adjusted under 35 U.S.C. 154(b) by 0 days.

(21) Appl. No.: 14/296,362

(22) Filed: Jun. 4, 2014

(51) Int. Cl.

| | |
|---|---|
| ***H01R 13/52*** | (2006.01) |
| ***H01R 33/00*** | (2006.01) |
| ***H01R 13/447*** | (2006.01) |
| ***H01R 27/00*** | (2006.01) |
| *H01R 13/62* | (2006.01) |

(52) U.S. Cl.
CPC ..... *H01R 13/447* (2013.01); *H01R 27/00* (2013.01); *H01R 13/5213* (2013.01); *H01R 13/62* (2013.01); *H01R 2201/26* (2013.01)

(58) Field of Classification Search
CPC . H01R 2201/26; H01R 13/5213; H01R 13/62
USPC ..... 439/142, 35
See application file for complete search history.

(56) References Cited

U.S. PATENT DOCUMENTS

| | | | | |
|---|---|---|---|---|
| 6,749,438 | B1 * | 6/2004 | Scheller | B60D 1/62 439/35 |
| 7,845,974 | B2 * | 12/2010 | Yue | H01R 13/72 191/12.4 |
| 2005/0176265 | A1 * | 8/2005 | Jacobs | H01R 13/502 439/35 |

* cited by examiner

*Primary Examiner* — Abdullah Riyami
*Assistant Examiner* — Justin Kratt
(74) *Attorney, Agent, or Firm* — Perkins Coie LLP

(57) ABSTRACT

A power connector for a vehicle includes a receptacle with a central opening that can receive a cylindrical connector. Within the central opening is a center contact and a number of electrical contacts arranged in a generally circular configuration around the center contact. The receptacle further includes an extension area on either side of the central opening that holds additional electrical contacts. A pair of covers are configured to open to expose the additional contacts and the center contact with the surrounding circular configuration of contacts. With both covers open, all the contacts in the receptacle are exposed.

10 Claims, 5 Drawing Sheets

VEHICLE POWER CONNECTOR

TECHNICAL FIELD

The disclosed technology relates to vehicle connectors and in particular to connectors that provide electrical power from a vehicle to a trailer.

SUMMARY

The disclosed technology relates to improvements in power connectors for automotive and commercial vehicle use. In one embodiment, a power connector includes a receptacle and a corresponding plug with mating electrical contacts. The contacts include a standard configuration of a center contact and a number of additional electrical contacts that are oriented in a circle around the center contact. The power connector also includes a number of additional electrical contacts positioned outside the standard configuration of electrical contacts. In one embodiment, the additional electrical contacts include 4 contact blades that are symmetrically placed around the center contact.

The receptacle has a circular opening that accepts a cylindrical plug to mate with the standard configuration of electrical contacts. The receptacle has a pair of additional openings that extend on either side of the circular opening that are configured to receive a correspondingly shaped plug. The receptacle has a pair of cover flaps including a first cover flap that covers the additional electrical contacts and a second cover flap that covers the standard configuration of electrical contacts. With the second cover flap opened, the receptacle is configured to receive a standard cylindrical plug that mates with the standard configuration of electrical contacts. With both cover flaps opened, the receptacle is configured to receive a plug that mates with both the standard configuration of contacts and with the additional contacts.

DETAILED DESCRIPTION

Figure 1:
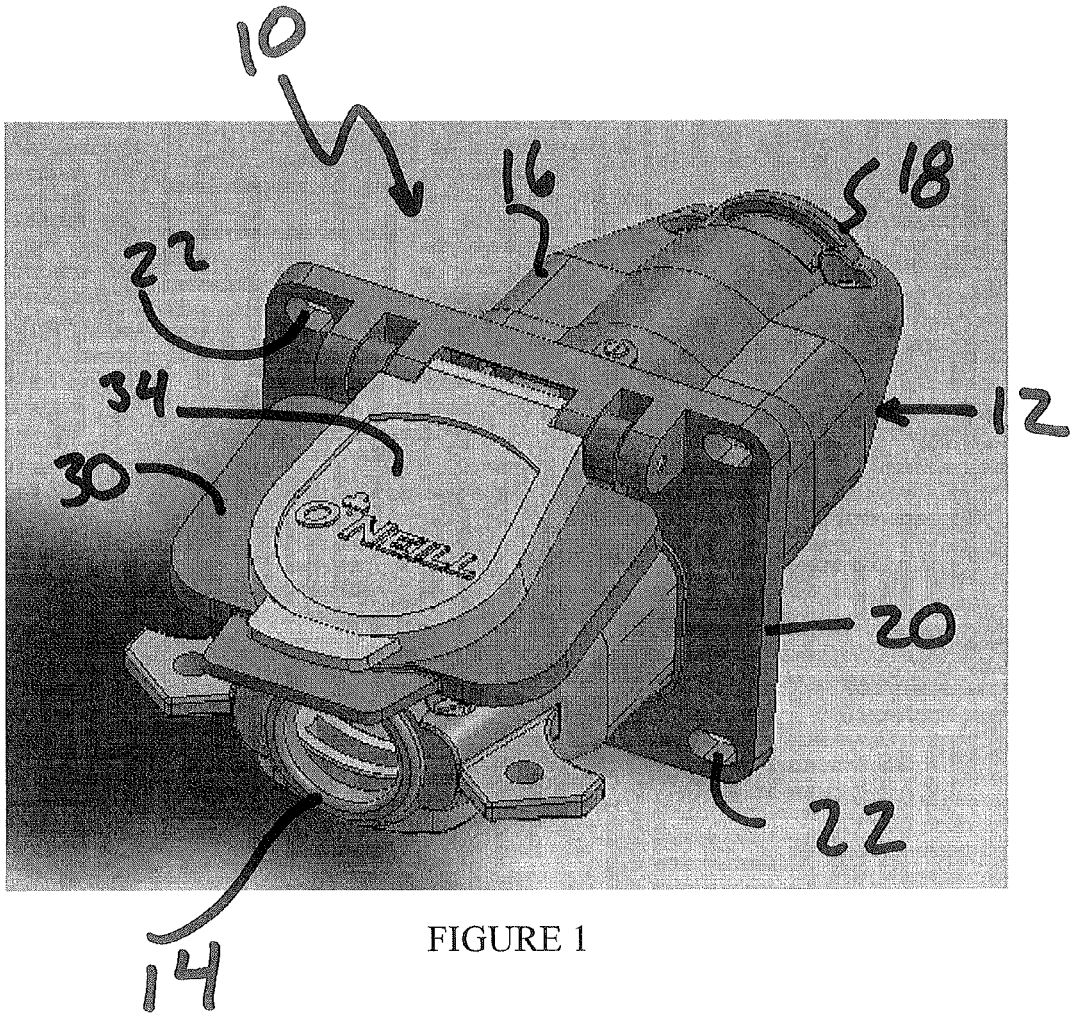
FIG. 1 is an isometric view of a vehicle power connector assembly in accordance with an embodiment of the disclosed technology.

An electrical connector in accordance with one embodiment of the disclosed technology is shown in FIG. 1. A connector 10 includes a receptacle 12 and a mating plug 14. The receptacle 12 has a body portion 16 with a first end into which electrical contacts are fitted and a second end that includes a strain relief 18.

The receptacle 12 has a generally rectangular faceplate 20 with holes 22 positioned in the corners to allow the faceplate to be secured to a surface of a vehicle. The faceplate is generally flush with an opening into the receptacle. A pair of spring loaded covers 30, 34 on the faceplate open and close to expose groups of electrical contacts within the receptacle 12 as will be explained below. In the embodiment shown, the covers rotate on a common axle pin that is located at the top of the faceplate 20. Each cover 30, 34 can be opened by swinging the cover about the axle pin and outwardly from the faceplate 20. Upon release, the covers are moved by the spring (not shown) to cover a portion of the opening in the front face of the receptacle.

With both the first and second covers 30, 34 positioned in an open position, the receptacle 12 can receive the plug 14 as shown in FIG. 1.

Figure 2:
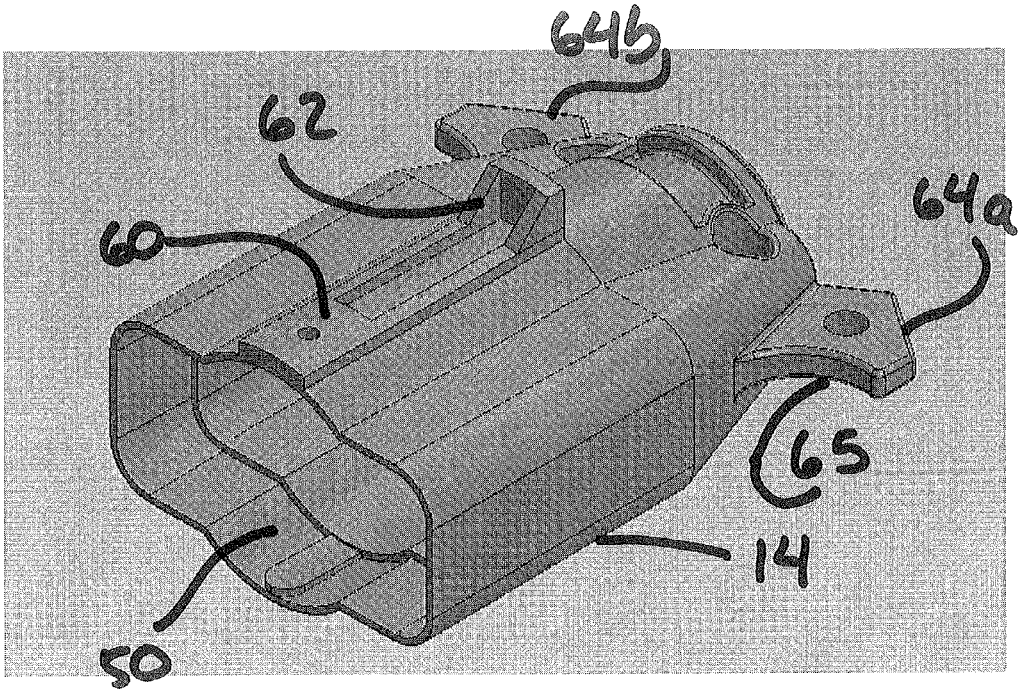
FIG. 2 is an isometric view of a receptacle without electrical contacts installed in accordance with an embodiment of the disclosed technology.
Figure 3:
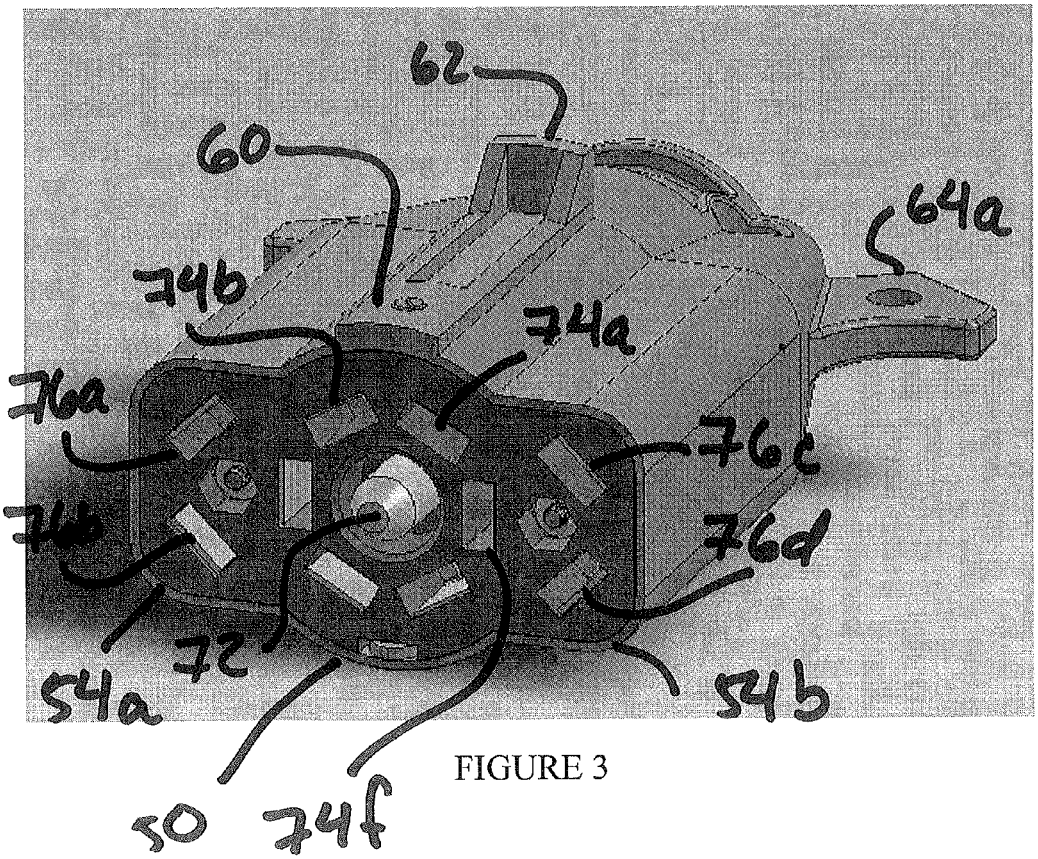
FIG. 3 is an isometric view of a plug with electrical contacts installed.
Figure 4:
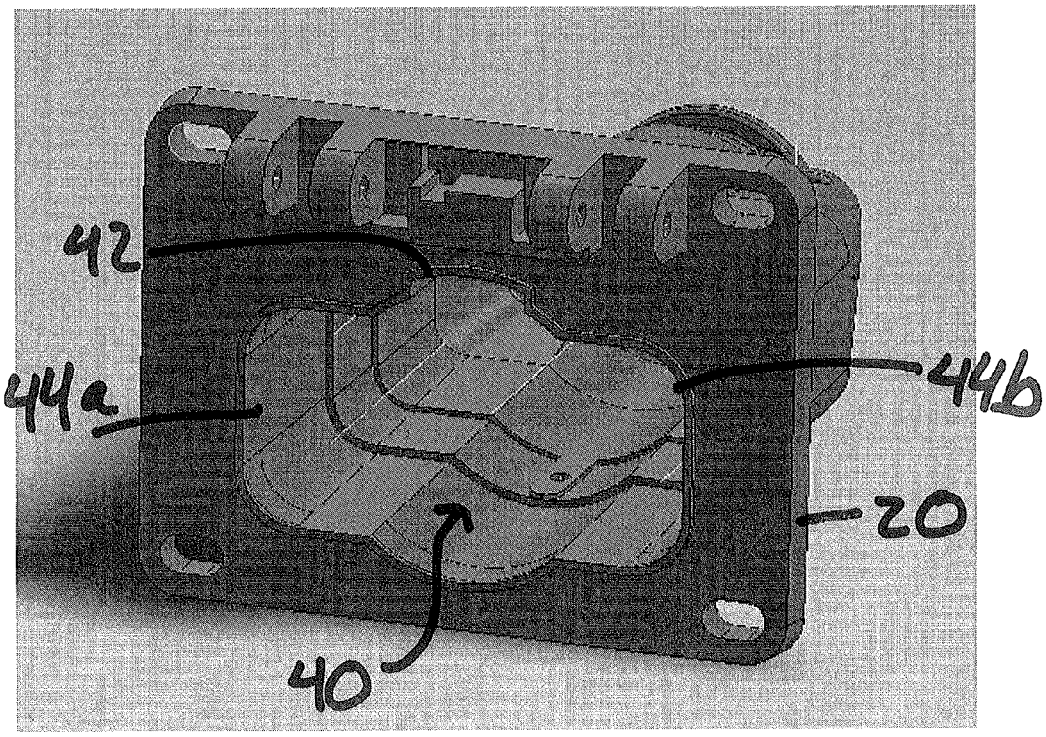
FIG. 4 is an isometric view of a receptacle without electrical contacts installed that mates with the plug shown in FIG. 3.

FIGS. 2 and 3 are isometric views of the plug 14 that fits within the receptacle 12. The plug 14 has a central portion 50 having a partially circular shape with a key 60 positioned on one side that fits into a corresponding keyway 42 on the receptacle (FIG. 4). Within the central portion 50 of the plug are a number of electrical contacts arranged in a conventional seven contact configuration. On either side of the central portion 50 are a pair of generally rectangular extension areas 54*a*, 54*b* having contacts 76*a*-76*d* that mate with corresponding electrical contacts positioned in extension areas 44*a*, 44*b* of the receptacle. In the embodiment shown, the electrical contacts include a center contact 72 and six surrounding electrical contacts 74*a*-74*f* that are positioned in a generally circular configuration around the center contact 72. This configuration of seven electrical contacts is well known in the field of automotive and vehicle power connectors.

The extension areas include additional electrical contacts 76*a*, 76*b* on one side and 76*c* and 76*d* on the other side. In the embodiment shown, the electrical contacts 76*a*-76*d* in the extension areas 54*a*, 54*b* are blade contacts that are oriented at approximately 45 degrees to an imaginary line running vertically and horizontally through the center of the front face of the plug 14.

Aligned with and spaced proximally from the key 60 is an outwardly extending tab 62. The tab is configured to fit behind a corresponding tab (not shown) on the back surface of the cover flap 34. In this manner, the tabs engage and the plug 14 cannot be easily removed from the receptacle 12 until the cover flap 34 is raised to a height sufficient to move the tab on the cover out of the way of the tab 62 on the plug 14.

At the proximal end of the plug 14 are two outwardly extending projections 64*a*, 64*b* having a curved inner surface 65 (FIG. 2) that form a stop against a user's fingers. When a user grasps the plug 14 with their hand, the curved surfaces 65 of the projections 64*a*, 64*b* provide an ergonomic surface for the user's fingers to pull the plug 14 out of the receptacle 12.

FIG. 4 is an isometric view of the receptacle 12 with the covers 30, 34 removed and no electrical contacts in the receptacle. The receptacle has a central opening 40 that is curved on its top and bottom sides into which a cylindrical plug (not shown) can be fitted. The opening has a keyway 42 on one side that receives a corresponding key 60 on a cylindrical plug to prevent the plug from being misaligned when inserted into the receptacle. On either side of the circular opening 40 is a pair of rectangular extension areas 44*a* and 44*b*. The extension areas 44*a* and 44*b* could be referred to as "wings" on either side of the central portion of the opening in the receptacle. The extension areas 44*a* and 44*b* provide access to additional electrical contacts in the receptacle 12.

Figure 5:
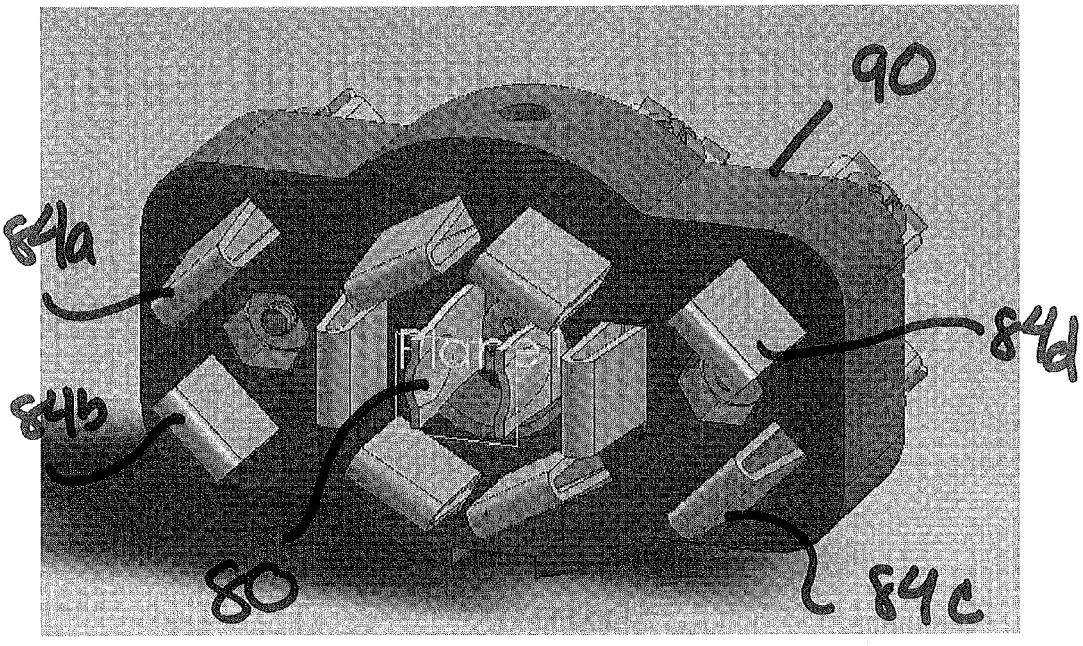
FIG. 5 is an arrangement of electrical contacts that fit within the receptacle shown in FIG. 4.

FIG. 5 shows an arrangement of electrical contacts that fit within the body portion of the receptacle 12 shown in FIG. 4. The electrical contacts include a center pair of center contacts 80 and a number of electrical contacts 82*a*-82*f* that are positioned in a generally circular configuration around the pair of center contacts 80. Additional electrical contacts 84*a*-84*d* are positioned in the extension areas that lie on either side of the circular arrangement of electrical contacts 82*a*-82*f*.

The electrical contacts shown in FIG. 5 are preferably secured in an injection molded insert 90 that is in turn held within the housings of the receptacle and the plug with a set screw, adhesive, over-molding or the like. Alternatively, the receptacle and plug can be molded as one piece with the electrical contacts in place. The housings and other components of the plug assembly can be made of metal, plastic, hard rubber or other materials.

During use, the receptacle 12 is able to receive a conventional cylindrical plug assembly to mate with the standard configuration of electrical contacts 80 and 82*a*-82*f*. The user lifts the outer cover flap 34 and can insert the cylindrical plug through an opening in the second cover flap 30. If the user desires to connect a trailer, RV, boat etc., that requires more electrical power, the user lifts both cover flaps 30, 34 and can insert a plug of the type shown in FIGS. 2 and 3 into the receptacle.

This eleven contact plug described has 60% more capacity allowing consumers and manufactures the ability to add features like ABS brakes, electric audible back up alarms, and locking trailer steer axles while still allowing the use of the existing seven contact plugs.

As will be appreciated, the disclosed technology adds the ability to add more power circuits without using the existing wiring of the vehicle. The design of the plug is such that one could wire it for an external power source like a generator or some other devise and do away with the need for extension cords running from the truck to the trailer or vice versa.

With the amount of extra connections one could wire the plug for 220 Volts, which would allow for the tow vehicle or trailer mounted generator to power up larger voltage equipment like A/C units, welders, and air compressors doing away with the need for large heavy and expensive extension cords.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A power connector for a vehicle comprising:

a receptacle with a central opening that is configured to receive a cylindrical plug, wherein the central opening has a center contact and a number of electrical contacts that are arranged in a generally circular configuration around the center contact; and an extension area on both sides of the central opening that holds additional electrical contacts, wherein the receptacle is also configured to receive a mating plug having a generally cylindrical portion and extension areas that extend on both sides of the generally cylindrical central portion with contacts that mate with the additional contacts in the extension areas of the receptacle.

2. The power connector of claim 1, further comprising:

a first cover that is configured to open and expose the center contact and the generally circular configuration of electrical contacts in the central opening and the additional contacts in the extension areas on both sides of the central opening; and a second cover that is positioned over the first cover and that is configured to open and expose the center contact and the surrounding generally circular configuration of electrical contacts without exposing the additional electrical contacts in the extension areas.

3. The power connector of claim 2, wherein the first cover has an opening to receive a cylindrical plug into the receptacle with the first cover in a closed position.

4. The power connector of claim 1, wherein the additional electrical contacts in the extension areas are symmetrically arranged about the center contact.

5. The power connector of claim 1, wherein the additional electrical contacts are oriented at approximately 45 degrees with respect to a vertical and horizontal axis of a front face of the receptacle.

6. The power connector of claim 1, further comprising a plug housing having a cross-sectional shape that fits within the central opening of the receptacle and the extension areas on both sides of the central opening.

7. The power connector of claim 6, wherein the plug has a pair of outwardly extending protrusions that are configured to engage a user's fingers when a user pulls the plug from the receptacle.

8. The power connector of claim 7, wherein the protrusions have curved ergonomic surfaces that engage a user's fingers.

9. An electrical power plug for a vehicle comprising:

a body with a generally cylindrical center portion having a center electrical contact and a number of additional electrical contacts arranged in a generally circular configuration around the center electrical contact; and an extension area on both sides of the generally cylindrical center portion that include additional electrical contacts, wherein the plug is configured to mate with a receptacle of the type having a partially circular central opening with a center electrical contact and number of electrical contacts that are arranged in a generally circular configuration around the center electrical contact; and an extension area on both sides of the partially circular central opening that includes additional electrical contacts.

10. A power connector for a vehicle comprising:

a receptacle with a single cavity that is configured to receive two different shapes of power connector plugs, wherein the cavity includes a partially circular center portion with a center electrical contact and number of electrical contacts that are arranged in a generally circular configuration around the center contact and wherein the partially circular center portion is configured to receive a generally cylindrical plug having a corresponding center electrical contact and a number of corresponding electrical contacts arranged in a generally circular configuration; and wherein the cavity of the receptacle also includes an extension area on both sides of the partially circular center portion that holds additional electrical contacts such that the cavity of the receptacle is also configured to receive a plug with a generally cylindrical central portion and an extension area on both sides of the generally cylindrical central portion with corresponding electrical contacts to engage the additional electrical contacts in the extension areas in the cavity of the receptacle.

* * * * *